United States Patent [19]

Da Rio et al.

[11] Patent Number: 4,942,543

[45] Date of Patent: Jul. 17, 1990

[54] METHOD FOR REGULATING THE PULL IN CONTINUOUS ROLLING TRAINS AND ROLLING TRAIN WHICH ADOPTS SAID METHOD

[75] Inventors: Luciano Da Rio, Artegna; Giovanni Bini, Moimacco, both of Italy

[73] Assignee: Danieli & C. Officine Meccaniche SpA and CEDA SpA Costruzioni Elettromeccaniche e Dispositivi d'Automazione, Buttrio, Italy

[21] Appl. No.: 193,528

[22] Filed: May 13, 1988

[30] Foreign Application Priority Data

May 15, 1987 [IT] Italy ..... 83372 A/87

[51] Int. Cl.[5] ..... G06F 15/46; B21B 37/06

[52] U.S. Cl. ..... 364/550; 364/472; 364/158; 72/29

[58] Field of Search ..... 364/472, 476, 158, 174, 364/550, 507, 552; 72/8, 29, 205, 20, 19; 382/8

[56] References Cited

U.S. PATENT DOCUMENTS

| | | | |
|---|---|---|---|
| 3,553,993 | 1/1971 | Frostick | 72/11 |
| 3,811,304 | 5/1974 | Gorker | 72/29 X |
| 4,089,196 | 5/1978 | Kondo et al. | 72/205 |
| 4,408,470 | 10/1983 | Fromont | 72/8 |
| 4,495,587 | 1/1985 | Plante et al. | 364/507 |
| 4,513,594 | 4/1985 | Ginzburg et al. | 72/20 X |
| 4,576,027 | 3/1986 | Yoshida et al. | 72/20 X |
| 4,662,202 | 5/1987 | Lambert | 72/8 |
| 4,706,479 | 11/1987 | Tominaga | 72/8 |
| 4,771,621 | 9/1988 | Sato | 72/8 |
| 4,776,192 | 10/1988 | Oda et al. | 72/20 X |

FOREIGN PATENT DOCUMENTS

| | | |
|---|---|---|
| 0041025 | 1/1985 | European Pat. Off. . |
| 2413492 | 10/1975 | Fed. Rep. of Germany . |
| 54-33250 | 3/1979 | Japan . |
| 810319 | 3/1981 | U.S.S.R. . |
| 1156998 | 7/1969 | United Kingdom . |
| 8002238 | 10/1980 | World Int. Prop. O. . |

OTHER PUBLICATIONS

Proceedings of the 8th AICA Congress, Simulation of Systems, 23rd–28th Aug. 1976, Delft, pp. 747–753, T. Yokota et al., "Hybrid Simulation of Tension Control System for Hot Tandem Mills".

AEG-Mitteilungen, vol. 56, No. 1, 1966, pp. 54–57, Berlin, DE; K. Hertlein: "Regeleinrichtung zum zug- und druckfreien Walzen in Knüppel- und Feinstahlstrassen".

Cahier d'Informations Techniques de la Revue de Metallurgie, vol. 79, No. 5, May 1982, pp. 407–417, Paris, FR; C. Boisdon et al.: "Réglage Automatique de la Traction Minimal Entre . . . Petits Fers".

*Primary Examiner*—Parshotam S. Lall
*Assistant Examiner*—Joseph L. Dixon
*Attorney, Agent, or Firm*—Wegner & Bretschneider

[57] ABSTRACT

Method to regulate the pull in continuous rolling trains, in which the value of a reference speed (V) is monitored in conditions where a bar is substantially free (not under drawing action) while said bar is being rolled, in which the measurement of the value of the reference speed (V) when the bar is substantially free of pull is obtained by means of variation of the speed (V) of the motor of the involved stand by an increase (x1) of the speed (V), by a return thereafter to the reference value of the speed (V) and by a reduction (x2) of the speed, followed by a final return to the reference speed (V) or realigned speed (V'), while monitoring the formation of a microloop on the rolled product. Rolling train for carrying out the above method, comprising for each stand an assembly to sequence a change of speed connected to a speed cascade control assembly and to an incremental assembly.

18 Claims, 2 Drawing Sheets

METHOD FOR REGULATING THE PULL IN CONTINUOUS ROLLING TRAINS AND ROLLING TRAIN WHICH ADOPTS SAID METHOD

This invention concerns a method for regulating the pull in continuous rolling trains and also continuous rolling trains which employ such method to regulate the pull.

It is known that in continuous rolling trains it is necessary to regulate the pull applied to the product during rolling so as to obtain the best dimensional tolerances.

This invention is therefore concerned with a method which enables the pull applied to the product being rolled in a continuous rolling train to be regulated, and also with the devices which employ such method.

Many systems besides the regulation of the loop have been developed in the prior art. Among them we can mention the system according to which the current of the motor as measured after entry of the head of a bar into the stand in question is memorized. In this system the regulation of speed takes place as a function of the current differences measured when the bar engages the following stand.

Such regulation enables a small part of a billet to be controlled and therefore does not act along the whole length of a bar being processed.

Next, another system exists which provides for the use of load cells applied to the stands.

These load cells measure the rolling pressure and enable the regulation to be performed as a function of the differences in signal thus detected while the conditions of pull are varying.

Document WO-A-8002238 discloses a method of adjustment of the tension in a continuous rolling plant.

According to this method, in order to adjust the pulling tension in a predetermined stand, an additional sinusoidal rotation is superposed on the next stand, and the torque variation on said predetermined stand is measured. The presence or the absence of torque gives a measure of the pull exerted on the rolled material within said predetermined stand.

Said method is complicated, since it requires a continuous monitoring of the situation on adjacent stands, and is subject to mistakes, since the torque variation measurement is rather difficult.

Furthermore, the speed of the stands should be varied over a spread range in order to obtain an appreciable response about the torque variation.

Finally, contrary to the present invention, it does not provide a measurement of the microloop appearing between adjacent stands.

Document SU-A-810319 discloses a continuous rolling mill tension control method by tentative speed change of one stand and changing drive speed of other stand. According to this method the currents circulating in the motor of a predetermined stand before and after a bar has reached the next stand are measured and compared.

A tentative speed change is introduced after the entry of the bar into said next stand. The current variation is therefore used in order to calculate the ideal speed of said predetermined stand.

This method differs fundamentally from the method according to the present invention, since it does not provide for the measurement of a microloop between adjacent stands.

Document US-A-4,662,202 discloses a low tension cascade mill speed control by current measurement with temperature compensation.

This is achieved by measuring the current circulating in the motor of a predetermined stand and varying said current by means of corrections based on temperature variations of the rolled material. Said temperature variations are correlated to the stand motor current by means of empirical constants.

Said control is subject to mistakes and is rather difficult to carry out. Anyway, it does not provide for the measurement of the microloop between adjacent stands.

Such inventions do not meet the technical and technological requirements since they are either extremely costly or require difficult setting or else do not allow a continuous regulation along the whole product being rolled.

The present applicant has designed, tested and embodied the present invention to overcome such drawbacks and to obtain a plurality of advantages.

A first advantage of the invention is that it enables the stands to be positioned more compactly, thus providing savings in the overall dimensions, space occupied, connections of usage means, etc.

A second advantage is the improvement obtained in the quality of the final product since the invention does not provide the formation of a loop between the stands and the results being that no distortions are created in the material.

Another advantage is provided from the fact that the control takes place, each time, on the motor of a single stand, without having to necessarily carry out measurements and comparisons with the parameters of the motors of adjacent stands, as in the case of the prior art control systems.

Another advantage is that the invention makes possible the processing of special sections such as, for instance, the sections for windows for which it is impossible to employ a loop-forming roll.

A further advantage is that the invention eliminates the loop forming machine and all the problems linked thereto.

These and other advantages are obtained by carrying out a method according to claim 1.

According to the invention the method comprises the regulation of the pull on the basis of the monitoring of the formation of a microloop measured when the bar is substantially free, namely when the bar in fact is not undergoing a drawing action although it is being rolled.

The method therefore arranges to take as a basic element the formation of a microloop in the rolled stock between one stand and the next when the stand is functioning but the rolled stock is certainly not being subjected to a pull.

The present parameters of employment of the stands such as speed, distance, etc. do not enable a reliable measurement of the value for comparison to be carried out during the time between the entry of the rolled stock into the stand involved in the regulation and the entry of the rolled stock into the next stand.

The measurement condition, namely the creation of microloops, is therefore obtained during processing by means of quick variations of a desired value and duration in the speed of the rolling stand involved.

According to the invention, converters, whether of a one-directional or two-directional type, are provided which feed and control the DC motors.

According to the invention the values of reference speed of the motor, such as the commands for variation of speed, the cyclic sequence of commands for variation and monitoring of the working current, are controlled basically by one single control system, which is advantageously a microprocessor system.

Such a single control system, which in practice can also consist of a plurality of separate units having the same overall function besides the special functions belonging to the invention, can supervise all the normal control functions which a modern rolling train requires.

According to the invention the functions proper to the method are the command for variation of the speed of the motor of the involved stand by an increase in speed, the return to the reference speed value, a variation by a reduction in speed and a final return to the initial reference speed, or to a different speed if the latter should be modified for obtaining the required pulling condition.

During the step of increase in speed there occur the comparison and monitoring of the position of the rolled stock passing through in relation to a zero position coinciding with the rolled stock under drawing action and containing no loops. Such zero position is pre-set.

In a further embodiment, such zero position is defined or redefined during the step of reduction in speed.

According to the invention, if a microloop is not formed during the step of increase in speed, thus signifying that the rolled stock is still under drawing action, then the cycle of increasing and reducing the speed is repeated but a higher reference speed is used to start the cycle until a microloop is obtained.

The method according to the invention is preferably carried put in sequence between two stands by moving forward by one stand.

According to the invention the speed of the downstream stand is kept constant and action is taken on the upstream stand.

While action is taken on the upstream stand with the cycle of variations in speed or with re-alignment of the reference speed, all the stands upstream of the one undergoing the variation method are subjected to analogous cycles of speed variations cascadewise. This means that the stands preceding the stand undergoing regulation remain linked in series to that stand.

Such link maintains a constant proportional relationship between the speeds of rotation of said preceding stands.

In the stand being controlled, when the speed leading to an absence of pull has been defined, such speed of non-pull is then reduced by a required value, thus providing the required pull.

According to the invention the variations in speed provided in the monitoring cycle are very small and lie between plus or minus 0.1% and plus or minus 5%. Interesting values are obtained with plus or minus 1%.

Formation of the microloop is detected by a linear photoelectric cell, which can also perform safety functions in the event of formation of an excessive loop.

According to a form of embodiment of the invention, the regulation sequence is carried out successively on all the stands which undergo the pull control, from upstream to downstream, and then repeated from upstream, and so on continuously or periodically according to requirements.

The control and regulation cycle is repeated even many times for each billet automatically, and the adjustments are suited to the rolling requirements in a timely manner.

According to a form of embodiment of the invention the speed increase takes palce in two successive steps, which are separated by a short time gap. The speed value of the first step corresponds to a condition of minimal pull.

According to a further and particularly advantageous form of embodiment, the increase and the reduction of the speed, which result, respectively, in the formation and in the dissolution of a microloop, are effected according to a continuous variation low, or by means of successive multiple steps or in a continuously adjustable way.

This allows an enhanced flexibility and the general monitoring of the procedure is made easier.

The attached figures, which are given as a non-restrictive example, show the following:

FIG. 1 uses a block diagram to illustrate the method of the invention;

FIG. 2A and B show the control cycles used by the method of FIG. 1;

Figure 1:
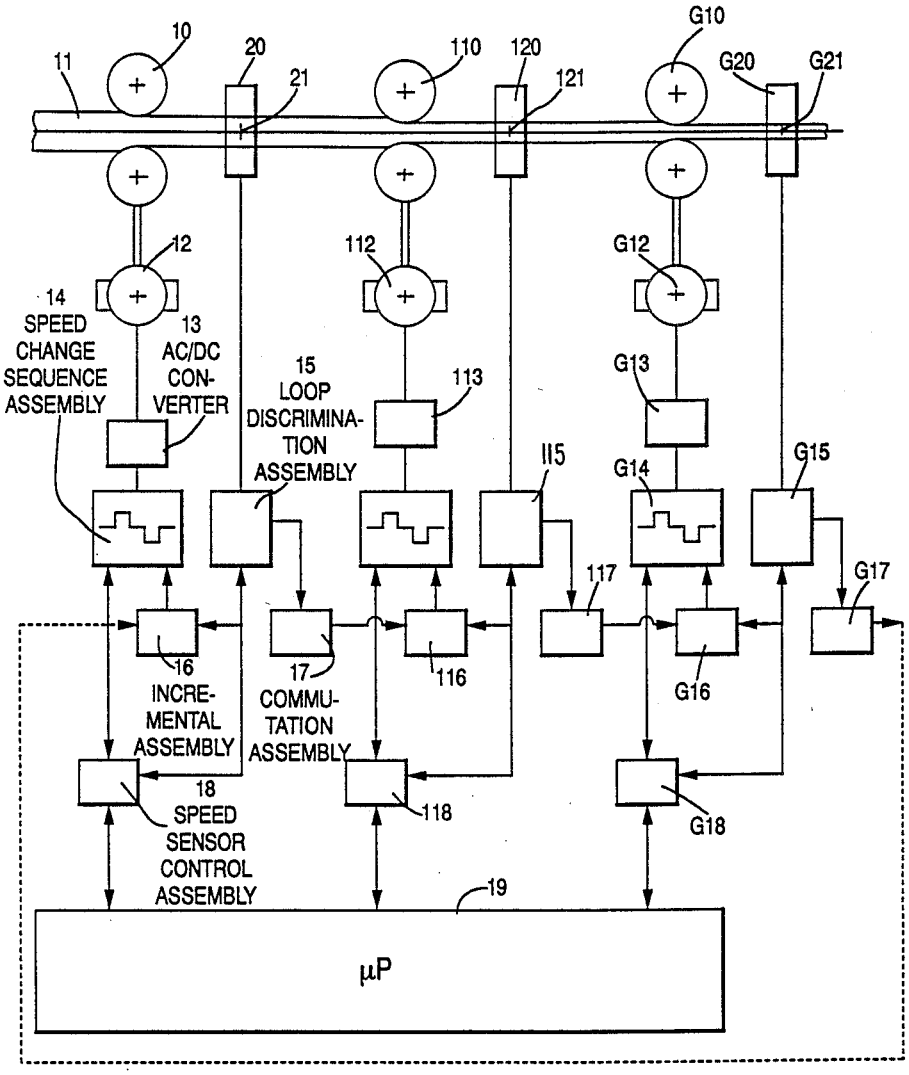

FIG. 1 shows a rolling train consisting of rolling stands or pairs of rolls 10. Such rolling rolls or stands 10 are called generically hereinafter "stands", and each of them includes a motor 12.

Each motor 12 is connected to a power unit with an AC/DC converter 13 to convert alternating current into direct current. This AC/DC converter 13 is connected to a speed change sequencer assembly 14, which in turn is connected to a speed series control assembly 18 and to an incremental assembly 16.

The speed series control assembly 18 is connected to a general processing unit 19, which is advantageously a microprocessor, on one side and on the other side to a loop discriminator assembly 15 and to the incremental assembly 16.

The discriminator assembly 15 governs a commutation assembly 17, which conditions the sequence of the action on the stand downstream.

The discriminator assembly 15 cooperates with a linear photoelectric cell 20 in determining the formation of a microloop due to lack of drawing action.

The photoelectric cell 20 works on the basis of a zero position 21 which coincides with the rolling axis.

Said photocell may be constituted by two elements which scan the bar according to directions which are perpendicular to each other and to said bar.

The zero position 21 may be pre-set, or else be monitored or determined in each regulation cycle in a pulling condition.

Each motor implies the presence of the above described assemblies and the last commutation assembly G17 conditions the first incremental assembly 16.

The AC/DC converter 13 may be of a two-directional or one-directional type with an analog or digital control.

A digital control provides greater accuracy and stability of speed.

The discriminator assembly 15 discriminates any formation of a microloop and also, for safety purposes, any formation of an excessive loop.

The incremental assembly 10 serves to increment the reference speed by a pre-set value.

The commutation assembly 17 switches the sequence according to the method to the successive stand, while the commutation assembly G17 switches the sequence to the first stand.

The speed series control assembly 18 controls serially the requested value of the reference speed and maintains the required relationship between the various stands which have already undergone regulation.

Figure 2:
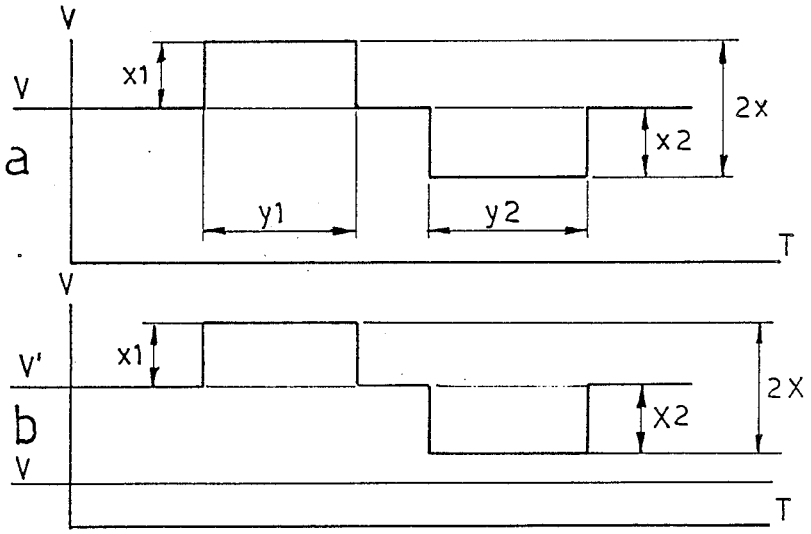

Let us now look at the method in detail with the help of FIG. 2.

The method can be applied and is feasible by using the formation of a microloop between two stands 10 under conditions of absence of drawing action.

Since the rolled stock 11 possesses lengthwise neither the same consistency nor the same temperature, the continuous or at least periodical repetition of the method enables a timely regulation of the pull to be obtained and kept near the required value.

FIG. 2 show the time T in abscissae; FIG. 2*a* indicates the behaviour of the reference speed V, while FIG. 2*b* shows the behaviour of the reference speed V′ as re-aligned to obtain a zero pull.

According to the method the speed V of the motor 12 is first increased by a value "x1" for a time "y1", is next brought back to the reference value V and is then reduced by a corresponding value "x2" for a time "y2", y1 and y2 being substantially identical.

In this case the values of x1 and x2 are substantially the same and lie between 0.1% and 5% of the value of V and advantageously have a value of about 1% of the value of V.

The increase in speed "x1" has the purpose of monitoring the rolling condition in the neighborhood of the zero pull condition; namely, in optimal rolling conditions, this increase should result in the formation of a microloop.

The reduction in speed "x2" has the purpose of collecting back the material in excess forming the microloop which had been accumulated during the time in which the speed had been set to "x1".

If the reference value V is reduced by a value x2 for a time y2 every microloop which may be comprised will be eliminated.

In this condition of no microloop, the zero position or reference position 21 may perhaps be obtained and detected.

If the rolled stock is still under drawing action when the speed V is increased by a value x1, then the reference speed V is re-aligned at a value V′ greater than V, and the sequence is performed again as in FIG. 2*b*.

The reference speed V′ is then re-aligned into V″ and so on in successive steps until the increase of the speed by a value x1 has the effect that a microloop is formed between the stand 10 and the stand 110.

The last reference speed (V′, V″, or other next speed) obtained in such a way will result, for the rolled stock between the stands 10 and 110, in a condition close to zero pull.

Once the new reference speed is reduced by predetermined value, the required pulling condition is obtained between the stands 10 and 110.

The reference speeds of all the upstream located stands are subsequently serially re-aligned on the basis of the last obtained value.

In this condition, where there is no microloop, it is possible to monitor and, eventually, to modify the reference position 21, which relates to the straight bar.

Action is then taken on the stand 110 by proportioning it to the successive stand, and so on.

When the method returns to act on the stand 10, it may work, as a first approach, on the determined speed, or else on the original reference speed V, that is to say, the pull imparted may be eliminated.

Figure 4:
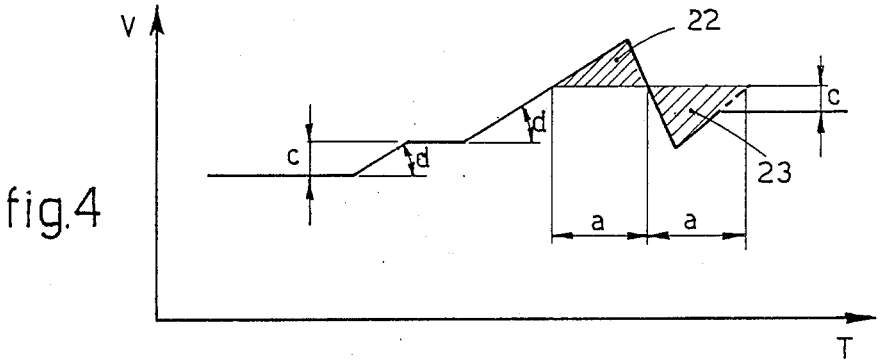
FIG. 4 shows a further kind of control cycles.

According to the form of embodiment of the invention illustrated in FIG. 4, the speed increase takes place in two successive steps, respectively "c" and "d", which are separated by a short time gap "a". Following to this, the speed is firstly mantained to a constant value for a time "b", then it is reduced by a value "d", it is mantained constant for a time "a", it is reduced again by a value "d" for a time "b" and finally it is increased again "d-c'".

The speed increase "c" has the purpose of eliminating the minimal pull existing before a cycle is carried out; "c'" corresponds to the new speed limit for determining the new minimal pull.

By way of example, the values assigned to said variables could be set to:

a=0.5 s;

b=0.7 s;

d=value of minimal required pull;

1–1.5% of the speed of the involved stand.

All the values are settable on-line on a control board; the value "c" may be set directly on the monitor.

Figure 3:
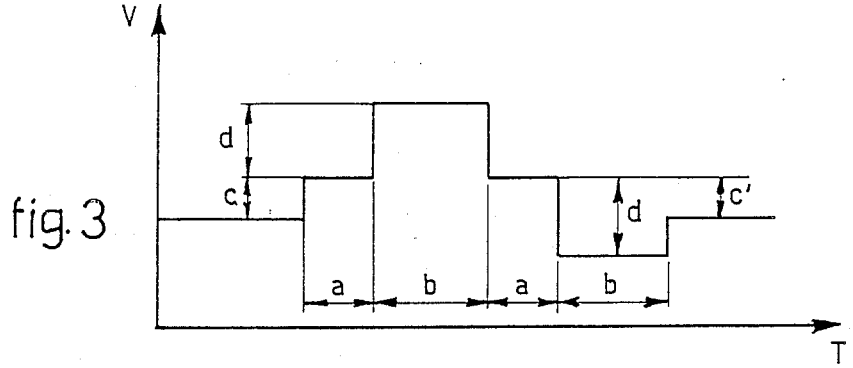
FIG. 3 shows another kind of control cycles.

According to another form of embodiment of the invention, the step of eliminating the minimal pull speed "c" is followed by, respectively, an increase and a reduction of speed which take place in a continuous way, and not suddenly as in the cycles described with reference to FIGS. 2 and 3.

In this case it is possible to define two zones 22,23 in which, for a time "a", a microloop is respectively formed and dissoluted.

In this case the formation and the dissolution of a microloop may be interactively determine the slope of the given speed cycle, particularly defining the moment of time in which the speed should varied from a gradual increase to a reduction or viceversa.

During the dissolution of the microloop, the final speed is set to a value smaller by a value "c" than the speed which defines a condition of zero pull, in order to obtain a minimal pull.

The slope "d" may be adjusted at one's needs in order to limit the surge of perturbation on the section of the rolled stock.

The procedure according to the invention may be carried out according to a sequence in which a frequent control is carried out on starting of the rolling train in order to obtain a fast regulation. Thereafter the control operation is carried out less frequently, since a speed close to the optimal speed has already been reached.

The automatic control for detecting the presence of a dangerous loop is constantly connected. This detects continuously the formation of loop oscillations going beyond the limits of an acceptable microloop. Said limits are preset, thus the control causes a speed cycle to be carried out, in order to eliminate that loop.

In the case where this control would intervene, a normal cycle for controlling the pull is successively carried out on the involved stand in order to restore the optimal rolling condition.

In the case where the motors would stop, the procedure is repeated as from the starting phase.

The invention employs the concept of obtaining momentarily the surpassing of a condition of drawing action between the stand 10 and stand 110 so that there occur a condition of a free bar and thereafter a condition of a possible thrust with the formation of a microloop, which is monitored by the linear photoelectric cell 20.

On completion of the sequence of search for the value V, the ratio between the speed V of the stand 10 and the speed of the next stand 110 is stored.

Steps are then taken by means of the commutation assembly 17 to switch the above sequence to the stand 110 and, in sequence, to all the stands up to G10.

All the stands will therefore by regulated so as to obtain their best working condition.

Regulation of the speed V leaves constant the speed of the finishing stand G10, and steps are taken to regulate the rolling train serially from downstream to upstream.

According to another form of embodiment of the invention the control may be simultaneously carried out on a plurality of stands and not only cascadewise.

We claim:

1. Method to regulate the pull in continuous rolling trains, with each stand set in rotation at the desired speed by its own motor so as to produce rolling conditions such as to be able to roll a bar in conditions almost free of pull, whereby a speed variation cycle is carried out, wherein the value of a reference speed is measured and varied to obtain formation of a microloop in the segment of the rolled product located between the stands, this variation of the value being associated with the monitoring of the microloop, and whereby the reference speed of the motor of the corresponding stand is varied for a specified time and this variation of the reference speed, when applied to the stand upstream of the zone of formation of the microloop, takes place with an increase of the reference speed followed by a successive return to the original reference speed and with a successive reduction of the speed followed by a final return to the reference speed or to the re-aligned speed.

2. Method as claimed in claim 1, in which the values of the variation of the reference speed (V) by increase (x1) of the reference speed and by successive return to the original reference speed (x2) are equal.

3. Method as claimed in claim 1, in which the specified time (y1-y2) of the duration of the variations of reference speed (V) by increase (x1) of the reference speed and by successive return to the original reference speed (x2) are equal.

4. Method according to claim 1, wherein the speed is increased or reduced in different steps, separated by a time gap, or continuously, based on monitoring of the amplitude of the forming microloop.

5. Method as claimed in claim 1, in which the temporary formation of the microloop during the cycle of speed variation indicates an operational condition of pull almost free of pull.

6. Method as claimed in claim 1, in which an absence of formation of a microloop during the speed variation cycle indicates an operational condition of pull not similar to a condition almost free of pull.

7. Method as claimed in claim 1, in which if the formation of a microloop is not detected, the speed variation cycle is repeated and is started with a higher speed.

8. Method as claimed in claim 1, in which, when the reference speed has been obtained with an almost zero pull, that reference speed is reduced to a determined value with a resulting proportional re-alignment of the desired speeds of the stands upstream.

9. Method as claimed in claim 1, in which the formation of the microloop is monitored with reference to a preset zero position.

10. Method as claimed in claim 9, in which the zero position of the microloop is checked and updated when the rolled product is in a position subject to pull.

11. Method as claimed in claim 1, wherein said method is applied by cascade connection to all the spaces between the stands forming the rolling train.

12. Method as claimed in claim 1, wherein said method is repeated at any time during the rolling of a bar.

13. Rolling train for carrying out a method to regulate the pull in continuous rolling trains, said method having each stand set in rotation at the desired speed by its own motor so as to produce rolling conditions such as to be able to roll a bar in conditions almost free of pull, whereby a speed variation cycle is carried out, wherein the value of a reference speed is measured and varied to obtain formation of a microloop in the segment of the rolled product located between the stands, this variation of the value being associated with the monitoring of the microloop, and whereby the reference speed of the motor of the corresponding stand is varied for a specified time and this variation of the reference speed, when applied to the stand upstream of the zone of formation of the microloop, takes place with an increase of the reference speed followed by a successive return to the original reference speed and with a successive reduction of the speed followed by a final return to the reference speed or to the re-aligned speed wherein said rolling train comprises for each stand an assembly to sequence a change of speed connected to a speed cascade control assembly and to an incremental assembly.

14. Rolling train as claimed in claim 13, further comprising an incremental assembly and a microloop discriminator assembly cooperating with a linear photoelectric cell and connected to said speed cascade control assembly.

15. Rolling train as claimed in claim 14, wherein the microloop discriminator assembly has a predetermined zero position.

16. Rolling train as claimed in claim 14, in which the microloop discriminator assembly has a self-determining zero position.

17. Rolling train as claimed in claim 13, further comprising a general processor unit to which the speed cascade control assembly of each stand is connected.

18. Rolling train as claimed in claim 13, further comprising a discriminator assembly governing a commutation assembly such that a last commutation assembly governs a first incremental assembly.

* * * * *